United States Patent [19]

Winkler et al.

[11] Patent Number: 4,843,277

[45] Date of Patent: Jun. 27, 1989

[54] SINGLE CRYSTAL EMITTER WITH HEATER WIRE EMBEDDED THEREIN

[75] Inventors: Otto Winkler; Hans Hofer, both of Balzers, Switzerland

[73] Assignee: Balzers Aktiengesellschaft, Liechtenstein

[21] Appl. No.: 101,575

[22] Filed: Sep. 28, 1987

[30] Foreign Application Priority Data

Sep. 29, 1986 [CH] Switzerland ..... 03898/86

[51] Int. Cl.[4] ..... H01J 1/22; H01J 9/04

[52] U.S. Cl. ..... 313/346 R; 313/336; 445/51

[58] Field of Search ..... 313/336, 337, 338, 340, 313/346 R, 346 DC; 445/51

[56] References Cited

U.S. PATENT DOCUMENTS

| | | | |
|---|---|---|---|
| 4,178,530 | 12/1979 | Lermacher et al. | 313/346 R X |
| 4,258,283 | 3/1981 | Brunger et al. | 313/336 |
| 4,482,839 | 11/1984 | Wada et al. | 313/336 X |
| 4,675,573 | 6/1987 | Miram et al. | 313/347 X |

*Primary Examiner*—Kenneth Wieder

*Attorney, Agent, or Firm*—McGlew & Tuttle

[57] ABSTRACT

Improved anchoring of heating elements of a resistance heater to thermally stressed single crystals is achieved by embedding the individual heating element in a recess in the single crystal and permanently joining this to the heating element by a porous sintered composition. The sintered composition is formed by the heat treatment of a suspension that in addition to other components, contains material with the same chemical composition in powdered form as that of the single crystal.

10 Claims, 2 Drawing Sheets

SINGLE CRYSTAL EMITTER WITH HEATER WIRE EMBEDDED THEREIN

BACKGROUND OF THE INVENTION

FIELD OF THE INVENTION

This invention relates in general to single crystals and in particular to a new and useful single crystal with at least one device for anchoring heating elements of an indirect resistance heater, especially thermionic emission cathodes for optoelectronic applications, preferably consisting of a boride or mixed boride of an element from the rare earth series and to a process for anchoring a heating element of an indirect resistance heater in a single crystal and the use of such single crystals.

Single crystals are heated by the principle of indirect resistance heating for very diverse areas of application. The permanent and maintenance-free anchoring of the heating element in the crystal body usually encounters difficulties. For optoelectronic applications, for example, single crystals of lanthanum hexaboride ($LaB_6$) or other borides are used as emission cathodes and are ordinarily heated by an indirect resistance heater, which represents a power lead at the same time, to an operating temperature between 1500° C. and 1600° C. In this range, the pitting of the crystal substances by vaporization becomes less important compared to the oxidation with residual gas containing $O_2$ and the subsequent vaporization of the boroxide and lanthanoxide. Accordingly, even at the high vacuum of $1\times10^{-5}$ pascal, the rate of attrition by oxidation is of the same order of magnitude as the rate of attrition by vaporization of $LaB_6$.

The result of this oxidation vaporization is that the hexaboride cathodes in all of the mounts that have been proposed up to this time more or less rapidly become loose in the course of time because of splitting if the vacuum is not better than $10^{-5}$ pascal.

As soon as a gap forms between the cathode and its mount, the positions of the cathode and its cathode spot change. The best transfer that now occurs partly by radiation and partly be thermal conduction also becomes unstable. If the cathode is included in the heater current path, the contact resistance also changes. Both of these lead to temperature variations with corresponding fluctuations of the emission.

Splitting can also not be avoided by a mount in which the $LaB_6$ cathode is clamped between two pyrolytic graphite jaws and the power feed and heating are accomplished by these jaws under spring pressure. It leads to a steady, frequently also sudden change of the contact resistance. This design is also very costly and requires substantially more space than a hairpin cathode.

Another method is disclosed by German Patent Application Disclosure 32 03 917 A1. According to it, the splitting between an $LaB_6$ cathode and its mount is overcome by joining the mount designed as a U-shaped bow and made of high-melting metal to the precisely matched $LaB_6$ single crystal that is used as the cathode, by sintering. To prevent a reaction between the cathode and the metal bow, a thin layer that consists of colloidal carbon and a reaction barrier material is introduced as a paste between the surfaces that are to be joined to one another. Since such an interlayer is brittle after the sintering, it cannot be exposed to any mechanical stress in operation. This requires long, flexible power leads. It was also stated here that because of the different coefficients of expansion of the mount and the cathode, cracks nevertheless form in the course of time that lead to a gradual impairment of the heat transfer from the heating element to the cathode, and ultimately to the loosening of the cathode.

Similar difficulties occur in other applications of heated single crystals.

SUMMARY OF THE INVENTION

The invention provides a permanent, reliable, and maintenance-free connection between thermally stressed single crystals and the element of an indirect resistance heater.

With this joint, it must be guaranteed that no modification embrittlement occur even at higher operating temperatures because of recrystallization. Finally, the invention should prevent the different expansions of the heating element and the cathode from leading to stress cracks when heated and cooled that impair the heat transfer.

The problem is solved by single crystals of the type described in the class definition that have the following features:

(a) the individual heating element is embedded in the shape of a slit formed in a recess in the single crystal, (b) the single crystal is permanently joined to this heating element by means of a sintered composition.

The invention is based on the knowledge that in view of the attack of oxygen on the thermionically stressed single crystal and a rate of vaporization of the material of this single crystal that is not negligible, a durable mechanical joint and a constant flow of heat between the single crystal and the heating element is achieved only when it is possible to find a material for the joint that adheres well both to the single crystal and to the heating element, i.e., that combines with them, and that is not subject to the same degradation by oxidation and vaporization as the single crystal.

It has been found that a substantially better solution of the problem of achieving a more durable heat transfer is obtained when the heat transfer from the heating element to the single crystal does not occur from the outside toward the inside as in the known method, but just the opposite, from the inside toward the outside. The single crystal is therefore no longer enclosed by the heating element, but the heating element is enclosed by the material of the single crystal. This is most simply accomplished by grinding a relatively narrow slit on one side of a cylindrical section of crystal that is only slightly wider than the diameter of the heating conductor, and by inserting the heating conductor in this slit by means of a sintering composition of relatively high-melting components, which combines both with the single crystal and with the heating conductor during the sintering.

An essential difference from the prior methods in which the heating element is laid on the single crystal or surrounds it is that the heat flow from the heating element pursuant to the invention occurs in all directions, and the heating element with the embedding composition is surrounded by the single crystal as if by a clamp, so that the tensile and compressive stresses that occur can be absorbed elastically and no longer lead to cracking.

In optoelectronic applications of cathodes made of lanthanum boride ($LaB_6$), a gradual decrease of the cathode temperature has always been found in: the past with constant heating current, as a result of the impairment of the heat transfer because of this cracking. With the anchoring of the heating element pursuant to the invention, on the other hand, the temperature increases to the same extent as the radiated power decreases as a result of the size reduction of the cathode surface because of the material degradation.

Even after a decrease of the cathode diameter from 1.0 to 0.8 mm, no impairment of the heat transfer could be found. The method pursuant to the invention therefore, makes possible longer operating times for the single crystals used.

Single crystals of any desired chemical composition conforming to the specific field of use can be used as the starting material for the device pursuant to the invention. For example, cylindrical, zone-melted $LaB_6$ single crystal rods with a <001> axis and a diameter of 1.0 mm are ordinarily used for thermionic cathodes for optoelectronic applications. The recess in which the individual heating element is placed can be of any desired shape, but slits or a slot with parallel walls, circular or conical segments or sectors, and bores, have proved to be particularly advantageous from the production viewpoint.

The shape of the heating elements to be anchored in the single crystal can of any desired shape, but for practical reasons, wires have proved to be particularly advantageous and suitable. These can beneficially be in the shape of a hairpin, with the Ushaped end being anchored in the single crystal.

For special applications, it may be beneficial to anchor a number of heating elements in a single crystal in the manner pursuant to the invention. These heating elements can optionally be used at the same time as power leads for direct resistance heating of the single crystal.

The material of the heating element is governed by the requirements of the specific individual application, for which chemical, electrical, and thermal characteristics must be taken into consideration in like manner. For example, heating elements that consist of tungsten, tantalum, or a tungsten-rhenium alloy with more than 50% tungsten have proved useful for anchoring in single crystals of lanthanum hexaboride ($LaB_6$).

Tantalum and the tungsten-rhenium alloy have the advantage that they remain sufficiently ductile even after the sintering process to permit a precise alignment of the cathode.

The composition of the sintering compound is likewise governed by the requirements of the individual application, but it has proved to advisable to provide for a fraction of a substance with the same chemical composition as the single crystal, preferably a volume fraction of approximately 50%, which guarantees a durable joint to the latter. For example, compositions that, in addition to the volume fraction of approximately 50% $LaB_6$ or of a hexaboride of a different element from the rare earth series, also contain one or more high-melting metals (for example, tungsten, tantalum, molybdenum, niobium, rhenium) or borides, silicides, or carbines of these elements that produce a durable bond to the heating conductor, have proved useful for the anchoring of heating elements in single crystals of lanthanum hexaboride ($LaB_6$).

The process for producing the single crystals pursuant to the invention has the following features:

(a) the heating element (1) to be embedded is placed in the desired position in the recess in the single crystal (2), (b) the sintering composition (3) is introduced into the recess in the single crystal (2) as a low-viscosity suspension of the various components.

(c) the sintering composition (3) is dried in the air, and then (d) is sintered under vacuum at temperatures above 2000° K. using the heating element (1).

This procedure pursuant to the invention produces a porous structure of the sintering composition that is better able than a dense crystal structure to absorb elastically the mechanical stresses that may occur between the heating element and the single crystal when heated or cooled. It has proved to be particularly beneficial if the average grain diameter of the components of this sintering composition at the beginning of the process is smaller than 5 um.

Some specific embodiments of the invention are described in detail below with reference to drawings, with the invention naturally not being limited to these specific forms of embodiment.

Accordingly, it is an object of the invention to provide an improved single crystal for anchoring heating elements of an indirect resistance heater, particularly a thermionic emission cathode for optoelectronic applications and which comprises a crystal body of an element from the series of rare earth, preferably boride or a mixed boride and having a recess therein and an individual heating element embedded in the recess of said body by a sintered composition.

A further object of the invention is to provide a process for anchoring a heating element of a resistance heater in a single crystal which comprises providing a recess in the single crystal positioning a heating element in the recess and adding a sintering composition into the recess as a low-viscosity suspension, thereafter drying the centering composition in air and then heating the sintering material under vacuum at temperatures above 2000° K. using the heating element.

A further object of the invention is to provide a single crystal which has a number of heating elements using this as an indirect resistance heater and as a power lead for direct resistance heating of a single crystal.

A further object of the invention is to provide a single crystal which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

GENERAL DESCRIPTION OF THE PREFERRED EMBODIMENTS

Figure 1:
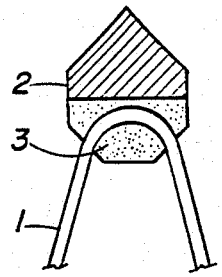
FIG. 1, is a section through a principle axis of a cathode for optoelectronic applications constructed in accordance with the invention.
Figure 2:
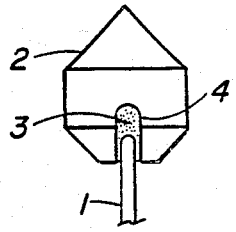
FIG. 2, is a side elevational view of the device shown in figure 1.

Referring to the drawings in particular, FIG. 1 shows a section along the principal axis of a cathode 2 for optoelectronic applications; FIG. 2 shows a side view of such a cathode with inserted heating element 1. This cathode 2 comprises zone-melted lanthanum hexaboride ($LaB_6$) with the desired crystal orientation, and has a ground-in slit 4 into which the heating element 1 is inserted. As an example, this can comprise a tungsten wire with a diameter of 0.125 mm that fits in the slit 4 with an open width of 0.15 mm, for example, which is otherwise filled with the porous sintered composition 3.

Figure 3:
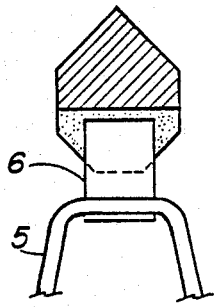
FIG. 3, is a principle axis sectional view of a hairpin-shaped crystal mount spot-welded to a thin sheet metal strip and constructed in accordance with the invention.
Figure 4:
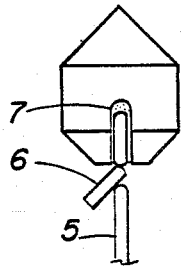
FIG. 4, is a side elevational view of the device shown in figure 3.

FIGS. 3 and 4 show a hairpin-shaped crystal mount 5 spot-welded to a thin sheet metal strip 6 made of tunsten, tantalum, niobium, or molybdenum, which in turn is sintered into the slit 7 of the cathode and transfers the heat. This solution is practical when a support is needed that also remains ductile even after the annealing and permits a subsequent alignment of the crystal.

Figure 5:
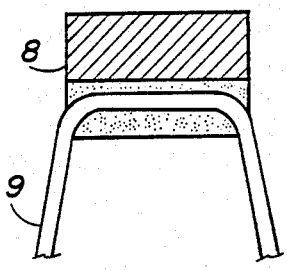
FIG. 5, is a sectional view along a principle axis of linear cathodes for optoelectronic applications constructed in accordance with the invention.
Figure 6:
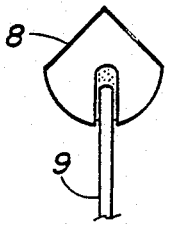
FIG. 6, is a side elevational view of the device shown in figure 5.

FIGS. 5 and 6 show a longitudinal section and an elevational view of linear cathodes for optoelectronic applications in which the heating element 9 is inserted into a longitudinal groove in the single crystal 8.

Figure 7:
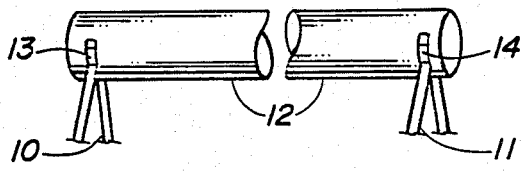
FIG. 7 is a side elevational view of a single crystal in which two heating elements are provided.

FIG. 7 shows an elongated single crystal 12 in which two heating elements 10, 11 are inserted into the corresponding recesses 13, 14 to provide for a uniform temperature distribution over the entire length. These heating elements 10, 11 can optionally be used at the same time as power leads for a direct resistance heater.

EXAMPLE 1

Cylindrical, zone-melted single crystal rods of lanthanum hexaboride ($LaB_6$) with a <001> axis and a diameter of 1.0 mm were cut to the desired length and ground conically at one end. A continuous (extending from one end of the crystal to the other) slit-shaped recess 0.15 mm wide was ground at the other end to a depth of 0.6 mm. A wire 0.125 mm in diameter made of a tungsten-rhenium alloy containing more than 50% tungsten by weight and bent into a U-shape was positioned in this recess with a micromanipulator in accordance with FIG. 1. The recess was then filled with a suspension that consisted of approximately 50% by volume of the boride of an element from the rare earth series, 40–42 vol. % molybdenum silicide, and of the high-melting metals mentioned previously (tungsten, tantalum, molybdenum, niobium, rhenium) as the remainder. These three components were suspended in a solution of 5% by weight of nitrocellulose in acetic acid (glacial acetic acid, anhydrous). The average grain diameter of all three components was less than 5 um. This suspension was then dried in the air for 2 to 3 minutes at room temperature. Finally, the single crystal treated in this way was heated for 1 minute at 2000° K. at a pressure of $p=10^{-3}$ pascal.

After this treatment, the sintered composition had a porous structure that could absorb elastically the mechanical stresses that occur during the heating and cooling of the single crystal.

While specific embodiments of the invention have been shown and described in detail to illustrate the application of the principles of the invention, it will be understood that the invention may be embodied otherwise without departing from such principles.

What is claimed is:

1. A single crystal for anchoring heating elements of an indirect resistance heater particulary a thermionic emission cathode for optoelectronic applications, comprising: a crystal body, said crystal body including an element from the series of rare earth elements, said crystal body having a top portion, a bottom portion, a first end a second end and said crystal body having a recess in the form of a continuous slot extending from said first end to said second end along the bottom of said crystal body, said slot having substantially parallel walls; an individual heating element embedded in said slot positioned extending throughout said slot parallel to said slot walls; and, a sintered composition permanently connecting said heating element to said crystal body in said slot.

2. A single crystal according to claim 1 further comprising: a second slot extending from said first end to said second end having slot walls parallel to each other, and a second heating element embedded in said second slot.

3. A single crystal according to claim 1 wherein said individual heating element U-shaped wire having a first end and a second end and a central portion position within said continuous slot extending from said first end of crystal body to said second end of said crystal body.

4. A single crystal according to claim 1, wherein said heating element contains at least one of the following elements: tungsten, tantalum.

5. A single crystal according to claim 4, wherein said heating element contains a tungsten-rhenium alloy with a tungsten fraction of more than 50%.

6. A single crystal according to claim 1, wherein said sintered composition contains material of the same chemical composition as said single crystal.

7. A single crystal according to claim 1, wherein said sintered composition contains lanthanum hexaboride.

8. A single crystal according to claim 1, wherein said sintered composition contains at least one of the following: tungsten, tantalum, molybdenum, niobium, rhenium.

9. A single crystal according to claim 1, wherein said sintered composition contains a silicide, boride, or carbide of one or more of the following elements: tungsten, tantalum, molybdenum, niobium, rhenium.

10. A process for anchoring a heating element of a resistance heater in a single crystal comprising, providing a continuous recess in the form of a slot formed in the single crystal said slot having substantially parallel walls, putting a heating element in the recess extending throughout said slot parallel to said, adding a sintering composition to the recess as a low-viscosity suspension of various components, drying the sintering composition in air, and then sintering the composition under a vacuum at a temperature above 2000° K. using the resistance heating element.

* * * * *